United States Patent [19]

Oohashi

[11] Patent Number: 4,463,224

[45] Date of Patent: Jul. 31, 1984

[54] DISTRIBUTOR FOR SUPPRESSING ELECTROMAGNETIC WAVES OF AN INTERNAL COMBUSTION ENGINE

[75] Inventor: Yutaka Oohashi, Himeji, Japan

[73] Assignee: Mitsubishi Denki Kabushiki Kaisha, Tokyo, Japan

[21] Appl. No.: 463,266

[22] Filed: Feb. 2, 1983

[30] Foreign Application Priority Data

Feb. 19, 1982 [JP] Japan ..... 57-26611

[51] Int. Cl.[3] ..... H01H 9/02; F02P 1/00

[52] U.S. Cl. ..... 200/19 DC; 123/146.5 A; 123/633; 200/304

[58] Field of Search ..... 200/19 R, 19 DR, 190 C, 200/304, 305; 123/632, 633, 146.5 A

[56] References Cited

U.S. PATENT DOCUMENTS 2,574,698 11/1951 Hall ..... 200/304 X
4,217,470 8/1980 Kirner ..... 200/19 DR X
4,384,178 5/1983 Nagai et al. ..... 200/19 DC X

FOREIGN PATENT DOCUMENTS 47110144 9/1974 Japan .
52-125937 10/1977 Japan .

*Primary Examiner*—J. R. Scott
*Attorney, Agent, or Firm*—Wenderoth, Lind & Ponack

[57] ABSTRACT

An ignition distributor for suppressing electromagnetic waves in an internal combustion engine wherein the distributor cap includes a material which functions to absorb electromagnetic waves radiated from the spark gap between the distributing electrode and the side terminal electrodes thereof. The cap may be formed of the material alone or with other materials or may be coated at its inside and/or outside surface with the material.

4 Claims, 4 Drawing Figures

DISTRIBUTOR FOR SUPPRESSING ELECTROMAGNETIC WAVES OF AN INTERNAL COMBUSTION ENGINE

BACKGROUND OF THE INVENTION

The present invention relates to an ignition distributor in an internal combustion engine and more particularly to an ignition distributor in an internal combustion engine which can suppress electromagnetic waves radiated from the discharge between a distributing electrode and side terminal electrodes constituting the distributor.

Hereinafter such an ignition distributor will be referred to as an ignition distributor for suppressing electromagnetic waves.

Some of the typical distributors hitherto well known of this kind are illustrated in FIGS. 1 and 2 of the attached drawings. FIG. 1 shows a distributor wherein the outer peripheral surface of the distributor cap of the distributor is plated by an electrically conductive metal; FIG. 2 shows a distributor where provided around the periphery of the distributor cap is a shield plate made of an electrically conductive metal. In FIGS. 1 and 2, which are side elevational views of the distributor as a whole, partially broken away, the reference numerals 1 and 2 denote a distributing electrode and a side terminal electrode, respectively, confronting each other with a gap g being left therebetween, distributing electrode 1 being adapted to be in contact with a center piece 3 to be supplied with high voltage electricity through a primary high-tension cable 4 from an induction coil, and center piece 3 is strongly urged by a spring 6 against distributing electrode 1 which is adapted to be rotated by a rotary shaft 5 that is in turn adapted to be connected to the crankshaft of the engine. Reference numeral 7 denotes a distributor cap which fixedly secures a number of circumferentially spaced side terminal electrodes 2, center piece 3 and spring 6 in position, and functions also to lead primary high-tension cable 4 to center piece 3 and secondary high-tension cables 8 to side terminal electrodes 2.

In FIG. 1 distributor cap 7 has its inner periphery plated with an electrically conductive metal 9. In FIG. 2 a shield plate 10 made of an electrically conductive metal is disposed around distributor cap 7.

In both conventional distributors shown in FIGS. 1 and 2, strong electromagnetic waves generated and radiated by the discharge between distributing electrode 1 and side terminal electrodes 2 are intended to be suppressed by an electromagnetic shield body provided on the inner surface of or around distributor cap 7. The electromagnetic shield body referred to here corresponds to an electrically conductive metallic layer 9 plated on the inner surface of distributor cap 7 in FIG. 1 or a shield plate 10 made of an electrically conductive metal arranged around distributor cap 7 in FIG. 2.

However, it has been proven that although in these conventional distributors the electromagnetic shield body is arranged around the distributor cap for the purpose of suppression of electromagnetic waves, the electromagnetic shield body cannot completely suppress the electromagnetic waves, its effectiveness therefore being not fully satisfactory.

OBJECTS AND SUMMARY OF THE INVENTION

It is an object of the present invention to provide an ignition distributor for suppressing electromagnetic waves in an internal combustion engine, which can eliminate the defects of conventional distributors of this kind.

It is another object of the present invention to provide an ignition distributor for suppressing electromagnetic waves in an internal combustion engine, which can effectively absorb electromagnetic waves radiated in the distributor.

It is a further object of the present invention to provide an ignition distributor for suppressing electromagnetic waves in an internal combustion engine, which has a stable effect in suppressing electromagnetic waves radiated in the distributor and is suitable for mass production, thereby reducing manufacturing costs.

In accordance with the present invention an ignition distributor for suppressing electromagnetic waves in an internal combustion engine having a distributing electrode connected to a rotary shaft for rotation, having a number of side terminal electrodes arranged close to the rotary locus of the distributing electrode with a discharge gap being left therebetween and having a distributor cap adapted to securely dispose the side terminal electrodes is provided, wherein mixed appropriately with the distributor cap or applied thereon is a electromagnetic waves absorbing material which principally comprises silicon carbide ceramics.

BRIEF DESCRIPTION OF THE DRAWINGS

These and other objects of the present invention and the invention itself will become more apparent from the following detailed description and the appended drawings, in which.

DETAILED DESCRIPTION OF THE PREFERRED EMBODIMENT

Figure 3:
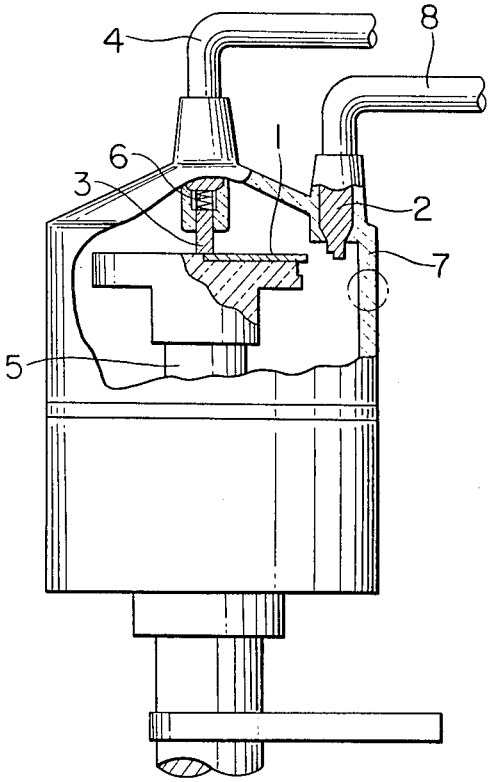
FIG. 3 is a side elevational view of one embodiment of an ignition distributor for suppressing electromagnetic waves in an internal combustion engine in accordance with the present invention, partially in section.
Figure 4:
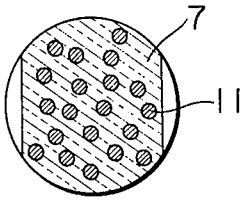
FIG. 4 is an enlarged sectional view of the portion of distributor encircled by the dashed line in FIG. 3.

Referring now to FIGS. 3 and 4 wherein the reference numeral 7 denotes a distributor cap in which is mixed electromagnetic wave absorbing materials 11 which principally comprise silicon carbide ceramics.

Figure 1:
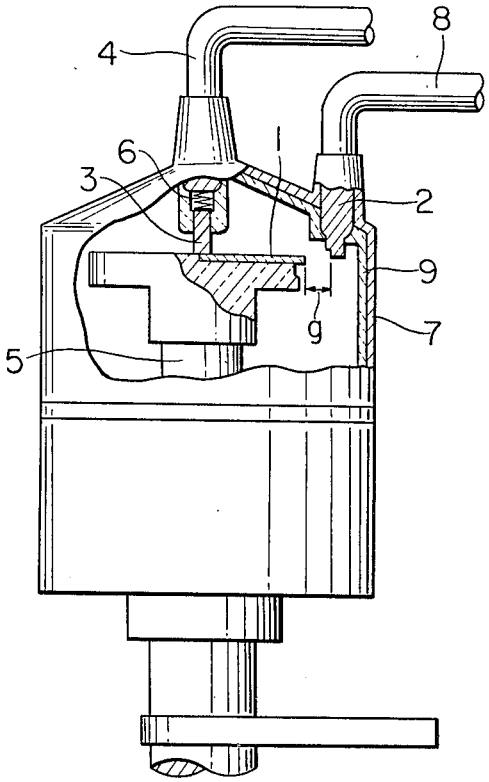
FIG. 1 PRIOR ART
FIGS. 1 and 2 are side elevational views of two examples of a conventional distributor for suppressing electromagnetic waves in an internal combustion engine, partially in section.
Figure 2:
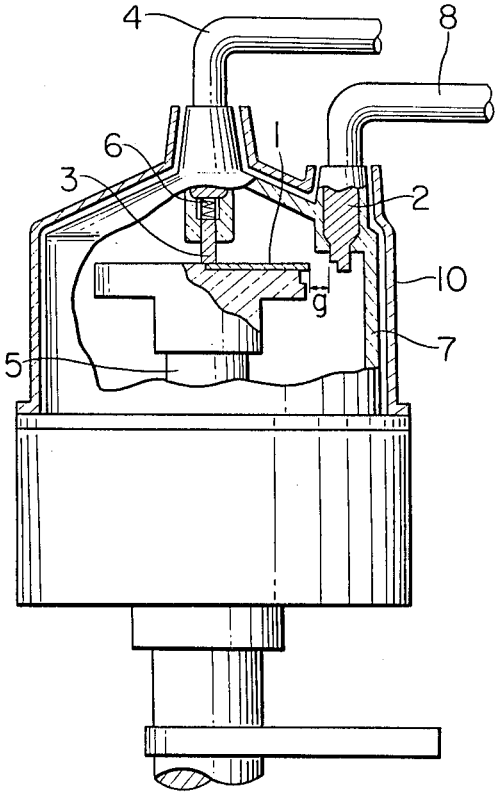
FIG. 2 PRIOR ART

The other reference numerals in FIG. 3 indicate respectively identical or similar elements shown in FIG. 1 or 2 bearing the same reference numerals.

Thus, in the embodiment shown in FIGS. 3 and 4, since electromagnetic wave absorbing materials 11 principally comprising silicon carbide ceramics mixed into the shaping material of distributor cap 7 functions to absorb electromagnetic waves transforming them into heat, the materials can absorb and damp strong electromagnetic waves radiated by the discharge between distributing electrode 1 and side terminal electrodes 2 so that the electromagnetic waves radiated from the distributor as a whole can be effectively suppressed.

Although in the above embodiment distributor cap 7 of the distributor the referred to electromagnetic wave absorbing materials 11 principally comprising silicon carbide ceramics are mixed into the shaping material of cap 7, a similar effect can be obtained when electromagnetic wave absorbing materials 11 are applied on at least one of the inner surface or the outer surface of distributor cap 7. Alternatively, distributor cap 7 itself may be formed of a material principally composed of silicon carbide ceramics.

Although a single preferred embodiment of the present invention has been described and illustrated, it will be understood by those skilled in the art that modifications may be made in the structure, form and relative arrangement of parts without necessarily departing from the spirit and the scope of the present invention.

What is claimed is:

1. An ignition distributor for suppressing electromagnetic waves in an internal combustion engine including a rotary shaft, a distributing electrode connected to said rotary shaft for rotation, a number of circumferentially spaced side terminal electrodes arranged close to the rotary locus of said distributing electrode with a discharge gap being left therebetween, and a distributor cap having said side terminal electrodes fixedly secure therein, said distributor cap including a material which functions to absorb electromagnetic waves radiated from said discharge gap, said material consisting principally of silicon carbide ceramics.

2. An ignition distributor for suppressing electromagnetic waves in an internal combustion engine as claimed in claim 1, wherein said distributor cap is formed of a mixture of said material and other materials.

3. An ignition distributor for suppressing electromagnetic waves in an internal combustion engine as claimed in claim 1, wherein said distributor cap is formed substantially entirely of said material.

4. An ignition distributor for suppressing electromagnetic waves in an internal combustion engine as claimed in claim 1, wherein at least one of the inside surface and the outside surface of said distributor cap is covered with said material.

* * * * *